US010996018B1

(12) United States Patent
Kempf et al.

(10) Patent No.: US 10,996,018 B1
(45) Date of Patent: May 4, 2021

(54) COCKING SLED FOR A CROSSBOW

(71) Applicant: Archery Innovators, LLC, Tiffin, IA (US)

(72) Inventors: James J. Kempf, Coralville, IA (US); Rex E. Isenhower, Mount Pleasant, IA (US)

(73) Assignee: ARCHERY INNOVATORS, LLC, Tiffin, IA (US)

( * ) Notice: Subject to any disclaimer, the term of this patent is extended or adjusted under 35 U.S.C. 154(b) by 0 days.

(21) Appl. No.: 16/875,532

(22) Filed: May 15, 2020

Related U.S. Application Data

(60) Provisional application No. 62/849,435, filed on May 17, 2019.

(51) Int. Cl.

| | |
|---|---|
| ***F41B 5/12*** | (2006.01) |
| ***F41B 5/14*** | (2006.01) |
| ***F41B 5/10*** | (2006.01) |

(52) U.S. Cl.
CPC ..... *F41B 5/1449* (2013.01); *F41B 5/105* (2013.01); *F41B 5/12* (2013.01); *F41B 5/1469* (2013.01)

(58) Field of Classification Search
CPC ..... F41B 5/12
See application file for complete search history.

(56) References Cited

U.S. PATENT DOCUMENTS

| | | | | |
|---|---|---|---|---|
| 7,174,884 | B2 | 2/2007 | Kempf | |
| 7,624,725 | B1 * | 12/2009 | Choma | F41B 5/1469 124/25 |
| 8,104,461 | B2 | 1/2012 | Kempf | |
| 9,285,182 | B2 * | 3/2016 | Bednar | F41B 5/1469 |
| 10,107,584 | B1 * | 10/2018 | Anderson | F41B 5/12 |
| 10,254,073 | B2 | 4/2019 | Yehle | |
| 10,356,152 | B2 * | 7/2019 | Lemoine | H04L 67/12 |
| 10,514,229 | B2 * | 12/2019 | Shaffer | F41B 5/12 |

* cited by examiner

*Primary Examiner* — John A Ricci
(74) *Attorney, Agent, or Firm* — Donald J. Ersler

(57) ABSTRACT

A cocking sled for a crossbow that is easier to remove from the bowstring once the crossbow is cocked, and easier to re-engage the bowstring in an effort to de-cock the crossbow.

12 Claims, 9 Drawing Sheets

COCKING SLED FOR A CROSSBOW

CROSS-REFERENCE TO RELATED APPLICATIONS

This is a nonprovisional patent application, which claims the benefit of provisional patent application No. 62/849,435 filed on May 17, 2019.

BACKGROUND OF THE INVENTION

Field of the Invention

The present invention deals with crossbows, and more generally with the cocking assembly, and specifically with a cocking sled for cocking a crossbow.

Discussion of the Prior Art

Prior art of U.S. Pat. No. 7,174,884 Kempf disclosed a crossbow cocking means of drawing a launch string from the center, by means known in the art. U.S. Pat. No. 8,104,461 Kempf disclosed a crossbow cocking means drawing a launch string from the center, having a flexible member wrapping a spool driven by a gear. U.S. Pat. No. 6,095,128 Bednar discloses a crossbow crank cocking device mounted on the stock having a sled engaged with the string, cranking the string into the cocked position, disengaging the sled from said launch string, and "parking" the sled with the stock. This type of sled has a large protrusion extending downward from the upper string engagement surface to well below the bottom of the string, below the upper surface of the barrel. This large protrusion is not an issue when cocking the crossbow, but it is a huge issue when removing the sled and disengaging the sled from the string after the crossbow is cocked, or when trying to put the sled back on the crossbow to de-cock the crossbow. There is significant interference between the protrusion and launch string. U.S. Pat. No. 10,254,073 Yehle discloses a moving latch assembly wherein a housing travels for and aft the crossbow frame, forward engaging a launch string, and rearward to cock the crossbow, the assembly contains a latch, a sear, a safety, and an anti dry-fire, wherein the trigger is fastened or attached to the center rail. Though the easiest to use, Yehle creates many issues wherein stacking tolerances may adversely effect the precision and reliability of the assembly, in that the trigger and trigger lever are de-coupled from the sear lever during every cocking cycle.

Advantageously, the present invention allows for a more reliable; more precise, easier to manufacture and easier to use cocking sled for a cocking system for a crossbow.

BRIEF DESCRIPTION OF THE PRESENT INVENTION

The present invention discloses a unique cocking sled. In a preferred embodiment, the cocking sled having a body, generally "U" shaped. The sled body is a structural element having an upper surface, a guide boss, an anti dry-fire de-activation boss, a string containment track, a flexible member journal, a barrel engagement surface, and an upper string engagement surface. The bowstring retainment track has a first half-track that is on a first side of the longitudinal center of the cocking sled, also known as the first leg, and the second half-track is on a second side of the longitudinal center of the cocking sled also known as the second leg. The barrel engagement surface is the lower surface of the structural element that joins the first leg and first half-track with the second leg and second half-track. The cocking sled is engage-able with a bowstring in an uncocked or "at rest" position, and when the bowstring is in the cocked position. The cocking sled may have multiple means for moving the cocking sled from a crossbow-uncocked position to a crossbow-cocked position. One of these means being a flexible member attached too, or coupled with the cocking sled. Handles or the like may be provided at the ends of the flexible member, and the cocking sled may be moved manually by pulling, as prior art has been done with rope cockers, or in a direct-pull fashion.

The cocking sled is removable from the launch string after the crossbow is cocked. Due to the cocking sled body having no protrusion below the upper string engagement surface rearward of the string retainment track, removal of the cocking sled is very easy after the crossbow is cocked.

In an alternate embodiment, a manual or powered mechanical (mopm) device coupled with a spool is used for winding or unwinding the flexible member, moving the cocking sled from a first position to a second position, and back to a third position, then forward to a fourth position, and back to the first position. The first position is where the cocking sled parked adjacent an mopm device; the second position is the sled engaging the launch string when the launch string is in the at-rest position; the third position is where the moving sled positions the bowstring with a string latch; the fourth position is forward said third position a distance sufficient to disengage the sled from the launch string when the launch string is in the cocked position and retained by the latch, allowing for the sled to be completely disengaged from the launch string. The upper string engagement surface of the cocking sled is above the upper tangent point of the launch string.

For sake of clarity, when the barrel or frame of the crossbow is level, it is on a first plane. The cocking sled has a barrel engagement surface, wherein this surface engages the top of the barrel or frame. The cocking sled has an upper string engagement surface above the barrel or frame. The bowstring engages the bowstring retainment track of the cocking sled and the barrel or frame upper surface. The cocking sled is manufactured such that when the barrel engagement surface of the cocking sled is parallel and engaged with the upper surface of the barrel or frame, and the user moves the cocking sled from the second position to the third position without tipping the rear of the cocking sled in a downward direction, the upper string engagement surface of the sled is never below the barrel engagement surface. Alternately, the cocking sled may tip as it is being moved from the second position to the third position, such tipping does not result in adverse conditions as relates to the use of the invention. A cocking sled of the present invention has no interference when disengaging or re-engaging with the bowstring, as there is no protrusion projecting downward below the upper string engagement surface of the cocking sled.

Multiple embodiments of the invention wherein the sled is movable manually by a rope, rope with handles, and crank cocking device, or any other method known in the art of moving a sled to cock and or de-cock a crossbow. Further, the present invention may be utilized with projectile launching devices that are known as "rail-less" in design.

DETAILED DESCRIPTION OF DRAWINGS

Figure 1:
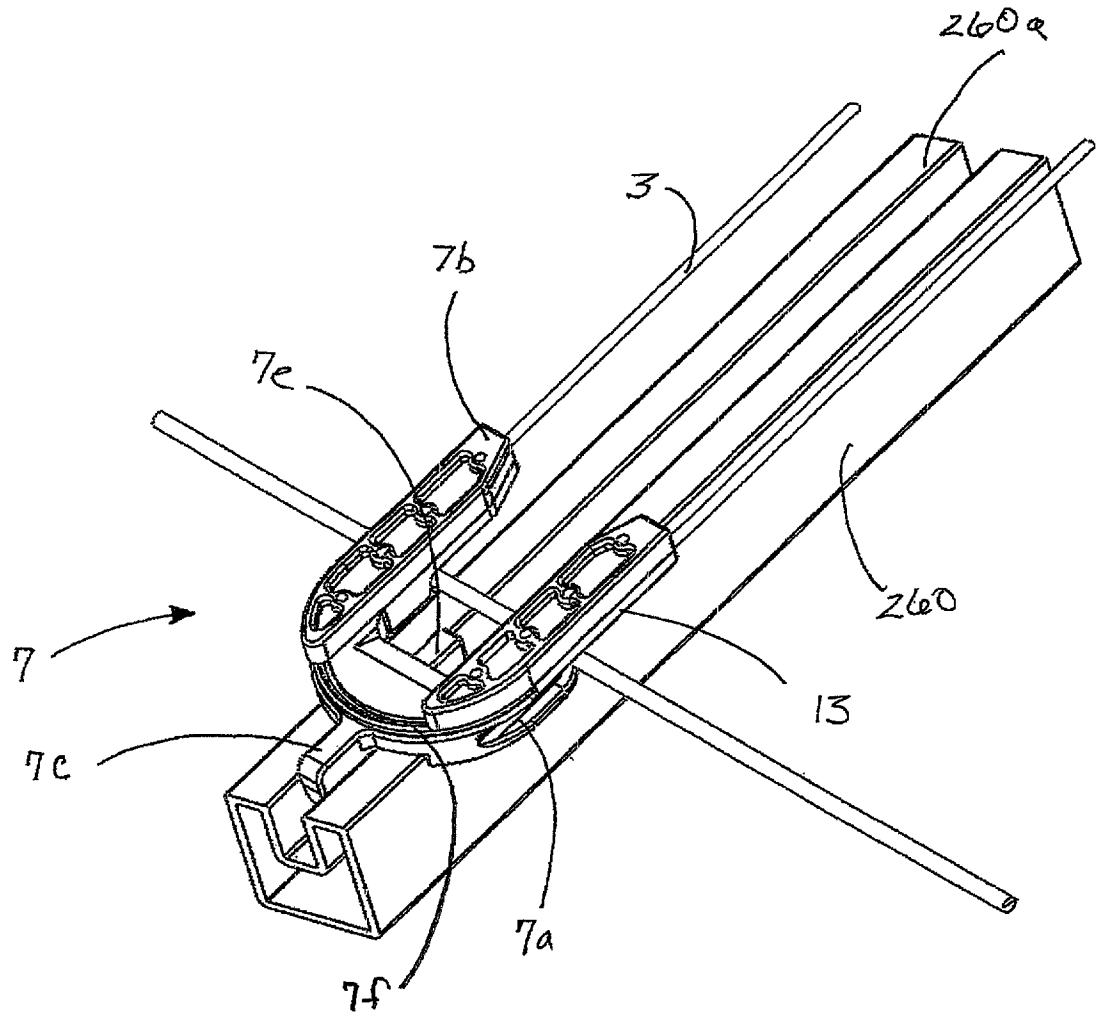
FIG. 1 is a view of a cocking sled wherein the cocking sled is engaged with a bowstring and a crossbow barrel of the present invention.

The present invention discloses a unique cocking sled. In a preferred embodiment, the cocking sled 7 having a body, generally "U" shaped. The sled body is a structural element having an upper surface, a guide boss 7*c*, an anti dry-fire de-activation boss 7*e*, a string retainment track 7*a*, a flexible member journal 7*f*, a barrel engagement surface 17, and an upper string engagement surface 7*d*. The bowstring retainment track 7*a* has a first half-track 15 that is on a first side of the longitudinal center of the cocking sled, also known as the first leg 13, and the second half-track 16 is on a second side of the longitudinal center of the sled also known as the second leg 14. The barrel engagement surface 17 is the lower surface of the structural element that joins the first leg 13 and first half-track 15 with the second leg 14 and second half-track 16. The cocking sled 7 is engage-able with a bowstring 100 in an uncocked or "at rest" position, and when the bowstring 100 is in the cocked position. The cocking sled 7 may have multiple means for moving the sled 7 from a crossbow-uncocked position to a crossbow-cocked position. One of these means being a flexible member 3 attached too, or coupled with the cocking sled 7. Handles 18 or the like may be provided at the ends of the flexible member 3, and the cocking sled 7 may be moved manually by pulling, as prior art has been done with rope cockers, or in a direct-pull fashion.

The cocking sled 7 is removable from the bowstring 100 after the crossbow 1 is cocked. Due to the cocking sled 7 having no protrusion below the upper string engagement surface 7*d*, removal of the cocking sled 7 is very easy after the crossbow is cocked.

In an alternate embodiment, a manual or powered mechanical device (mopm device) 11 coupled with a spool (not shown) is used for winding or unwinding the flexible member 3, allowing or causing movement of the cocking sled 7 from a first proximal position, which is parked adjacent the mopm device 11, to a second distal position to engage and retain the bowstring 100 and back to a third position wherein the cocking sled positions the bowstring 100 with a string latch (not shown), then forward to a fourth position which is forward the third position a distance sufficient to disengage the cocking sled 7 from the bowstring 100 when the bowstring 100 is in the cocked position and retained by the latch, and back to the first proximal position parked adjacent the mopm device 11. The upper string engagement surface 7*d* of the cocking sled 7 is adjacent the string retainment track 7*a* and the upper tangent point of the bowstring 100.

For sake of clarity, when the barrel or frame 260 of the crossbow is level, it is on a first plane. The cocking sled 7 has a barrel engagement surface 17, wherein this barrel engagement surface 17 engages the barrel or frame upper engagement surface 260*a*. The cocking sled 7 has an upper string engagement surface 7*d* above the barrel or frame 260. The bowstring 100 engages the bowstring retainment track 7*a* of the cocking sled 7 and the barrel or frame upper engagement surface 260*a*. The cocking sled 7 is manufactured such that when the barrel engagement surface 17 of the cocking sled 7 is parallel and engaged with the upper engagement surface of the barrel or frame 260*a*, and the user moves the cocking sled 7 from the second position to the third position without tipping the rear of the cocking sled 7 in a downward direction, the upper string engagement surface 7*d* of the cocking sled 7 is never below the barrel or frame upper engagement surface 260*a*.

Alternately, the cocking sled 7 may tip as it is being moved from the second position to the third position, such tipping does not result in adverse conditions as relates to the use of the invention. A cocking sled of the present invention has no interference when disengaging or re-engaging with the bowstring, as there is no protrusion projecting downward below the upper string engagement surface of the sled.

Figure 1A:
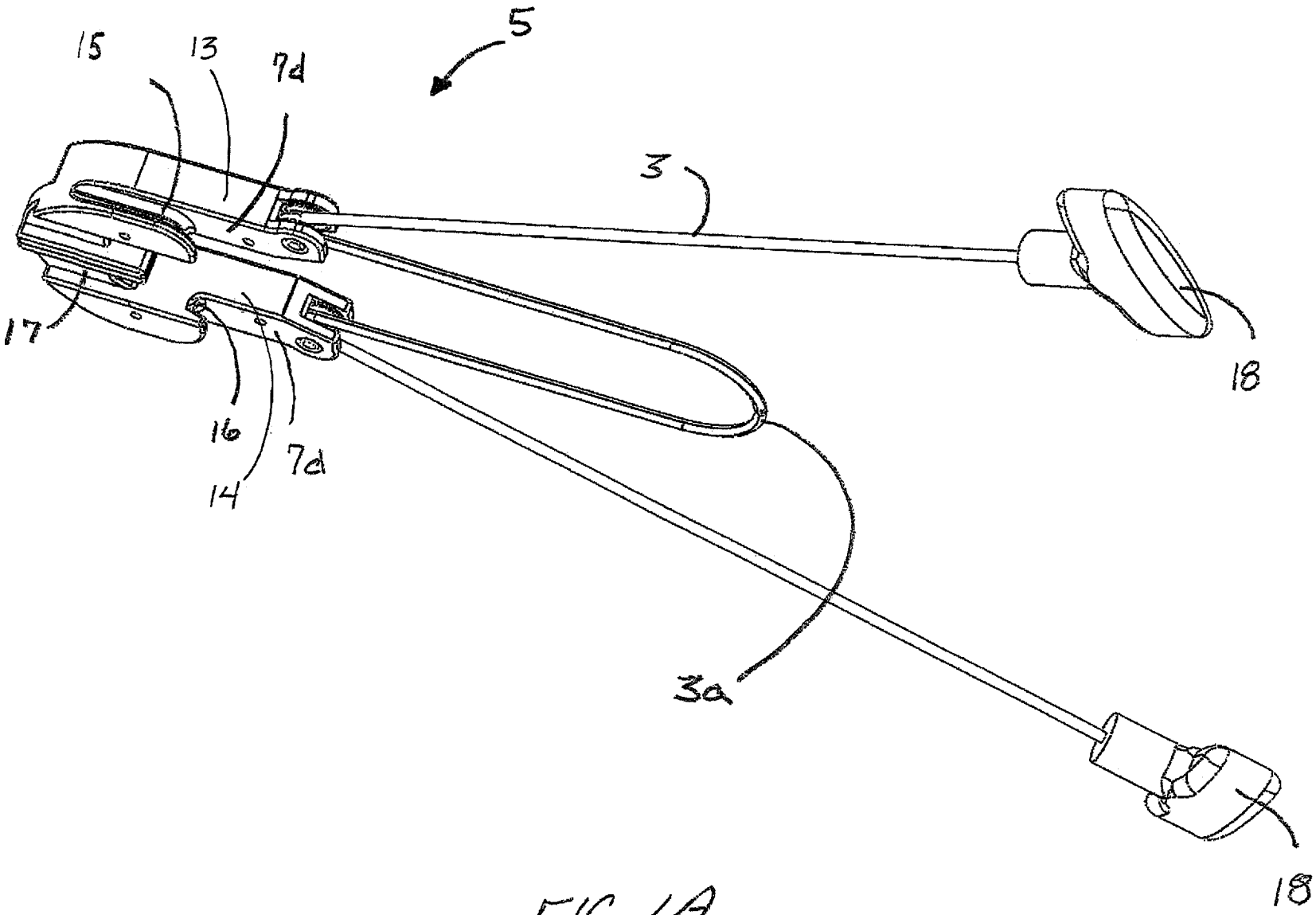
FIG. 1A is a view of the integrated components of what is known in the art as a rope cocker with the cocking sled of the present invention.
Figure 1B:
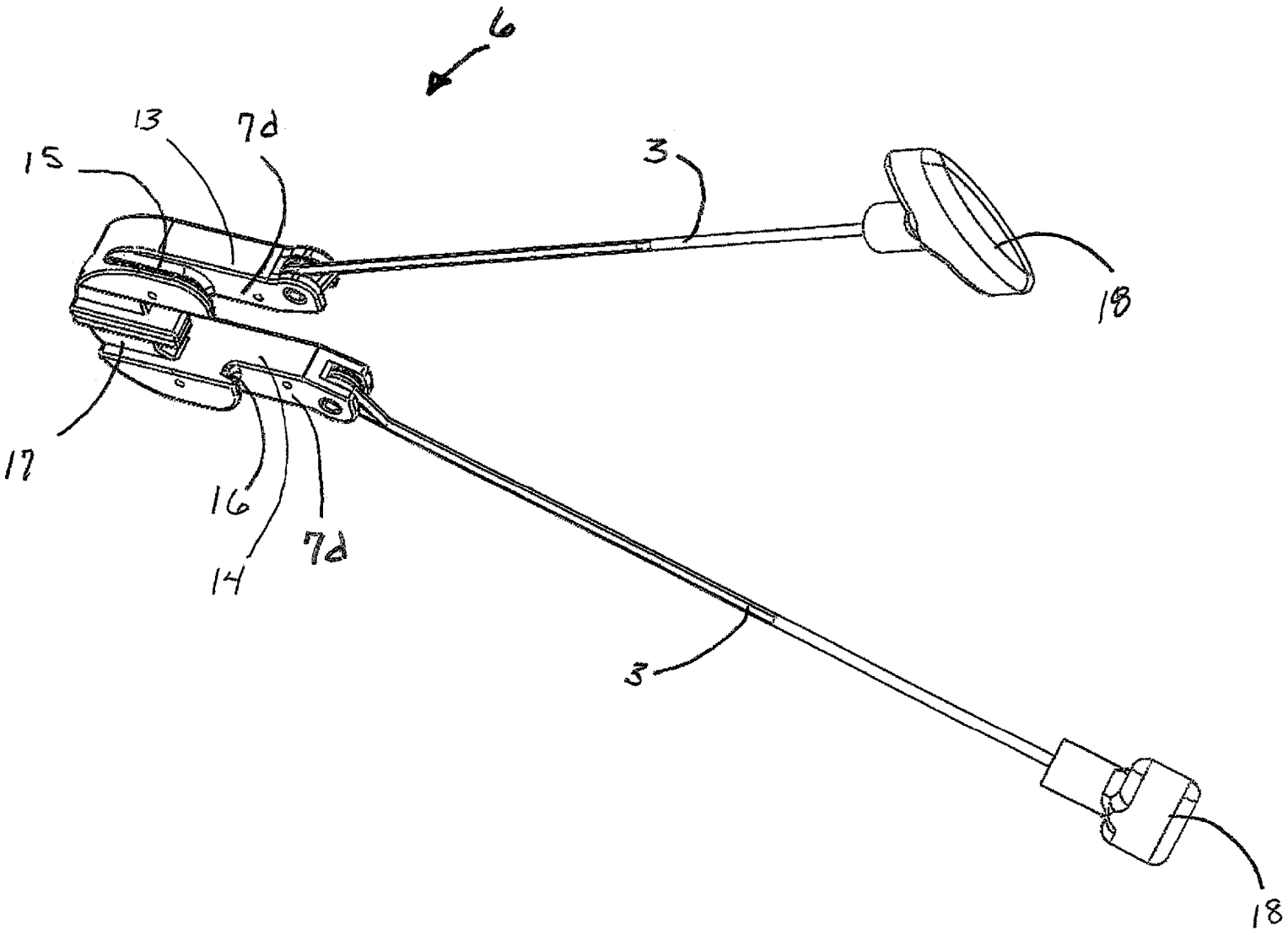
FIG. 1B is a view of the integrated components of what is known in the art as a direct-pull cocker with the cocking sled of the present invention.
Figure 2:
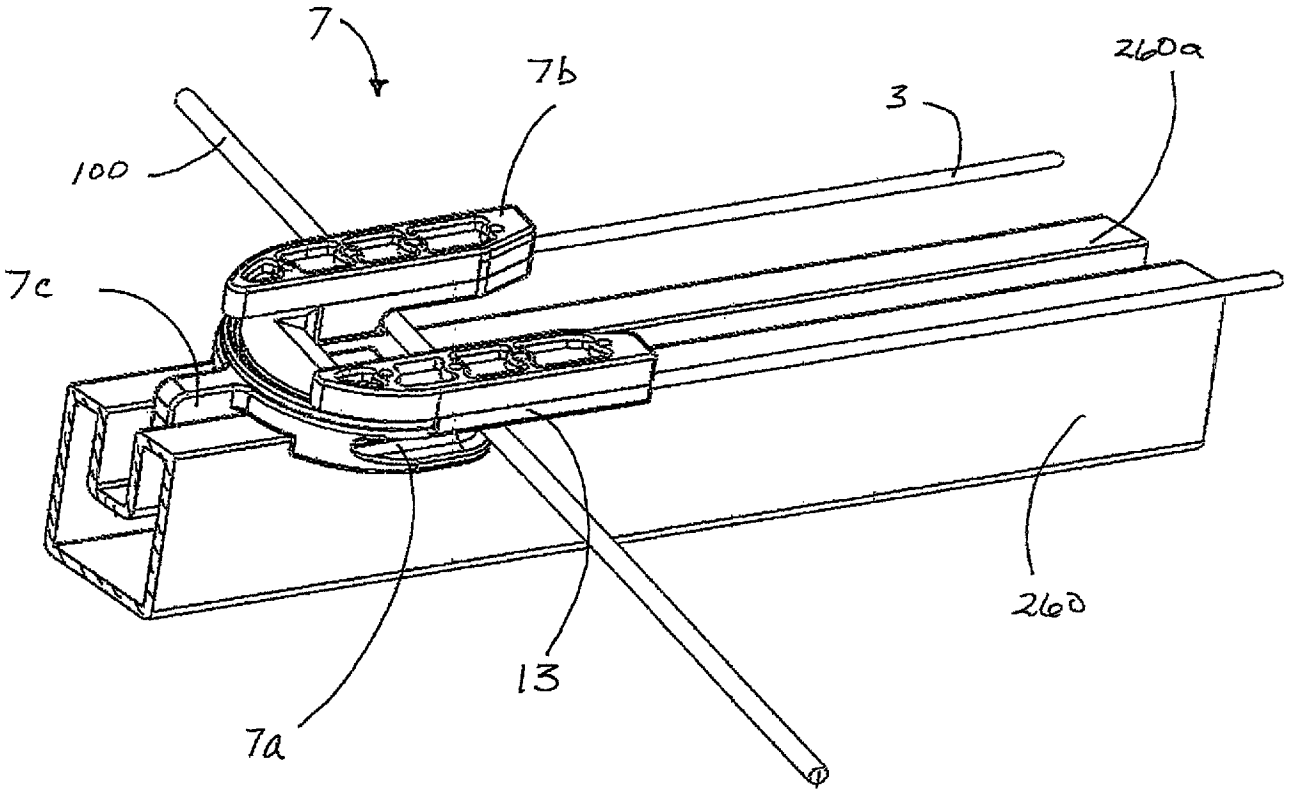
FIG. 2 is a partial view of a cocking sled wherein the cocking sled is engaged with a bowstring and a crossbow barrel of the present invention.
Figure 3:
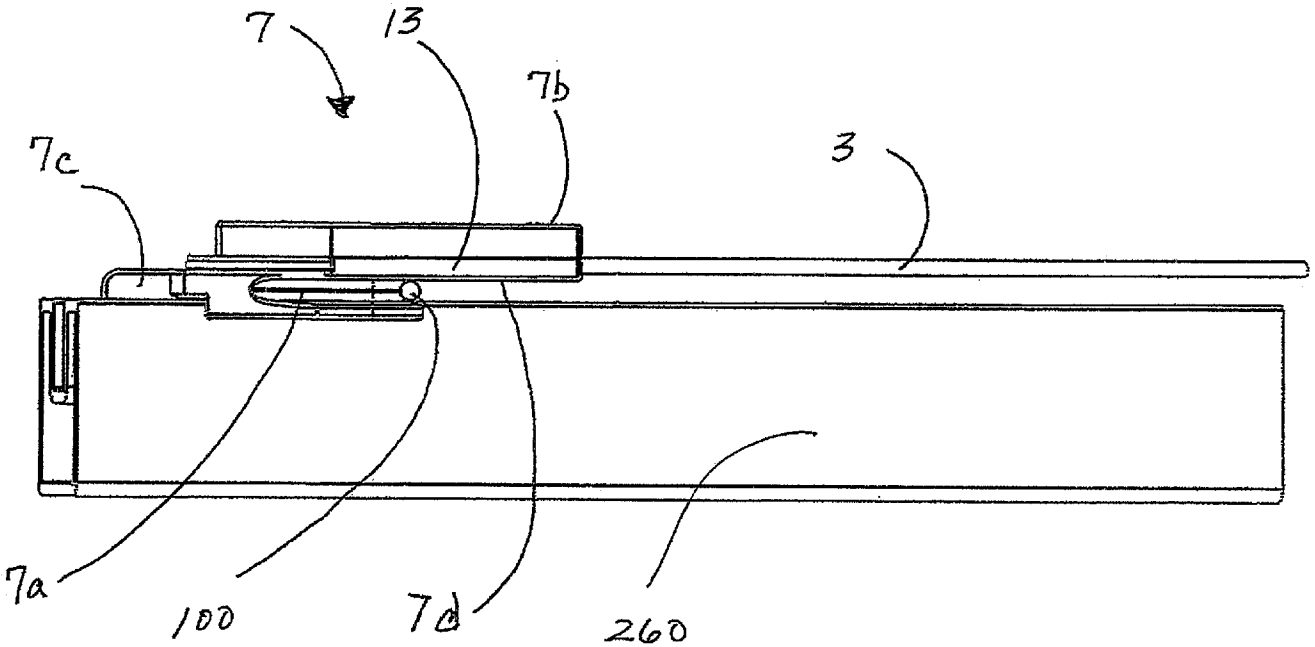
FIG. 3 is a side view of a cocking sled engaged with a bowstring and a crossbow barrel, when the barrel is level and the cocking sled is properly engaged with the barrel, and upper string engagement surface of the cocking sled is not below the upper surface of the barrel of the present invention.
Figure 4:
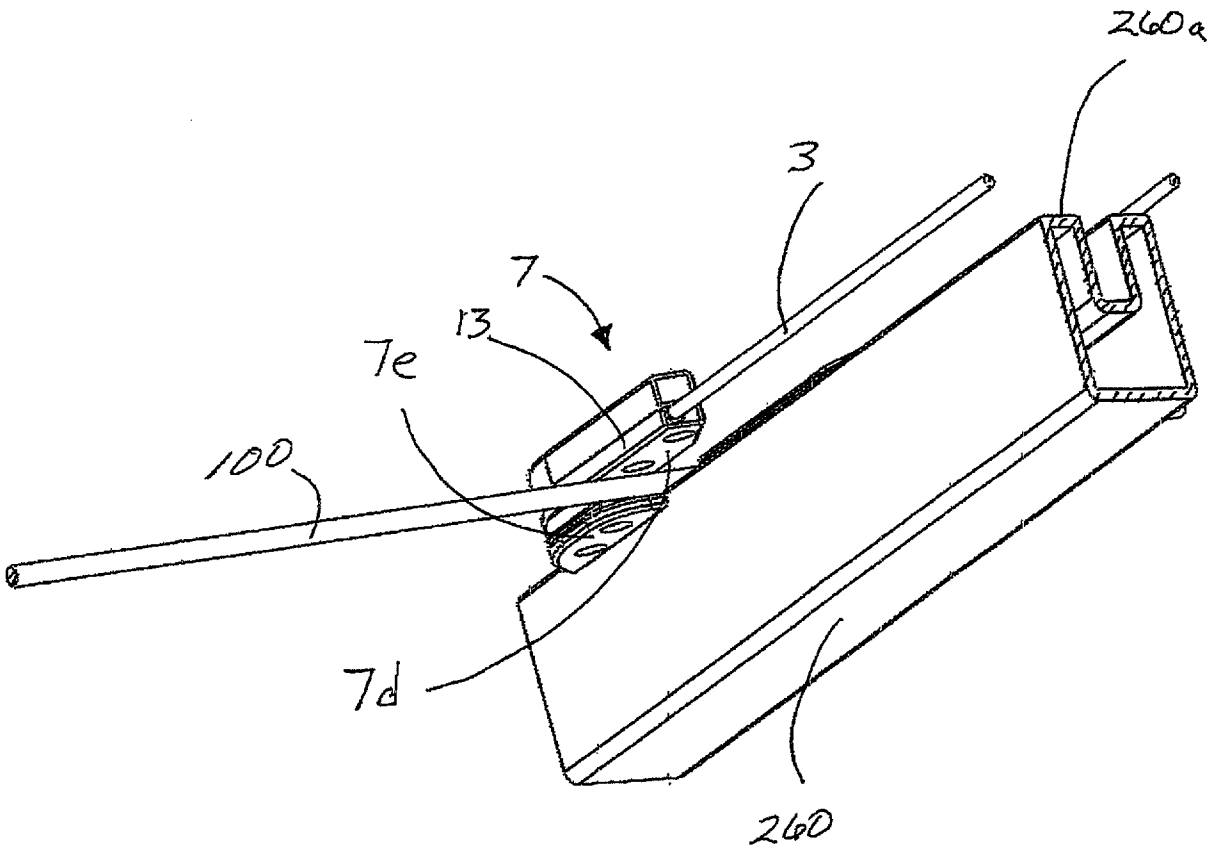
FIG. 4 is a view of a cocking sled wherein the cocking sled is engaged with a launch string and a crossbow barrel of the present invention.
Figure 5:
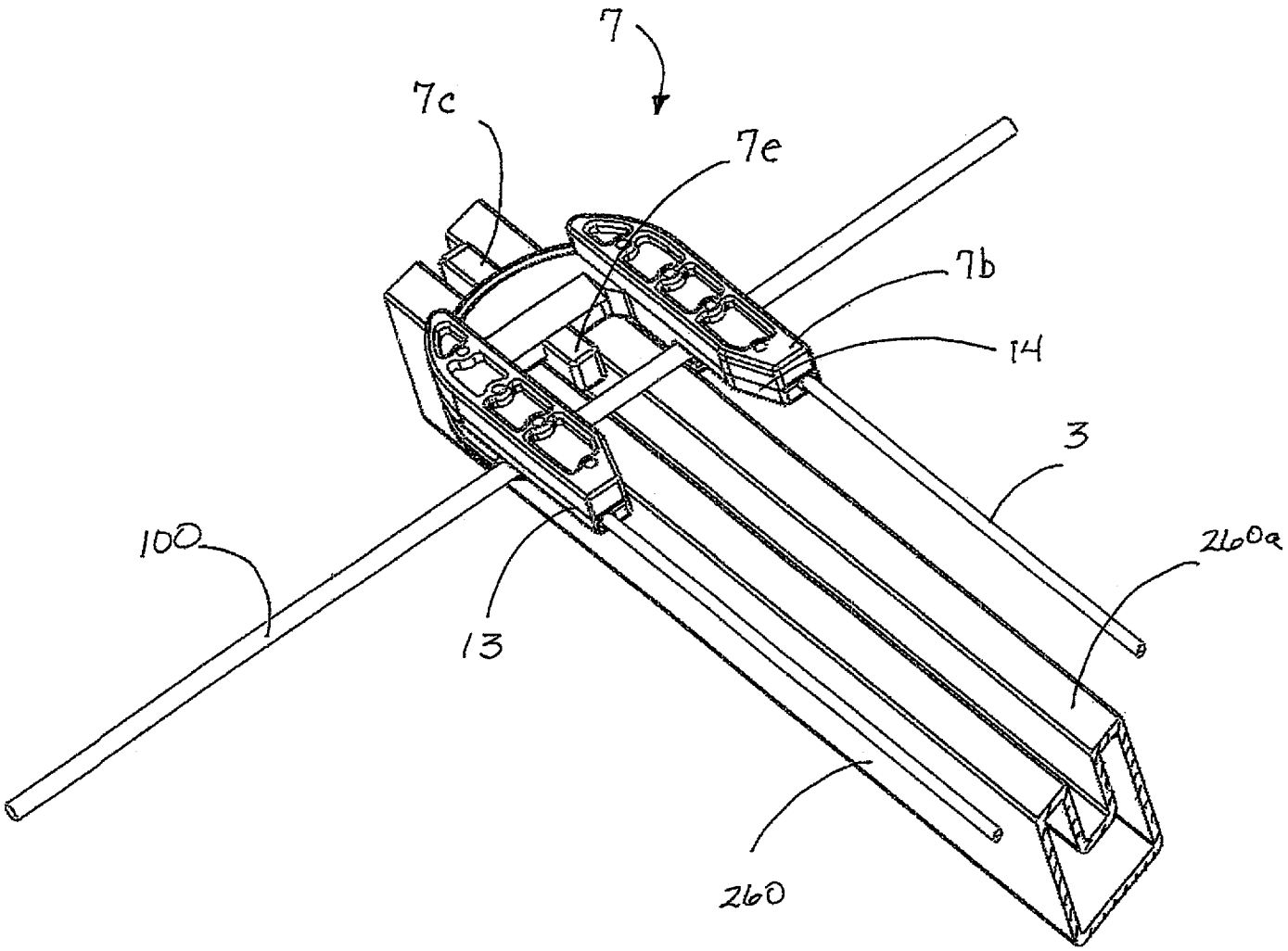
FIG. 5 is a view of a cocking sled wherein the cocking sled is engaged with a launch string and a crossbow barrel of the present invention.
Figure 6:
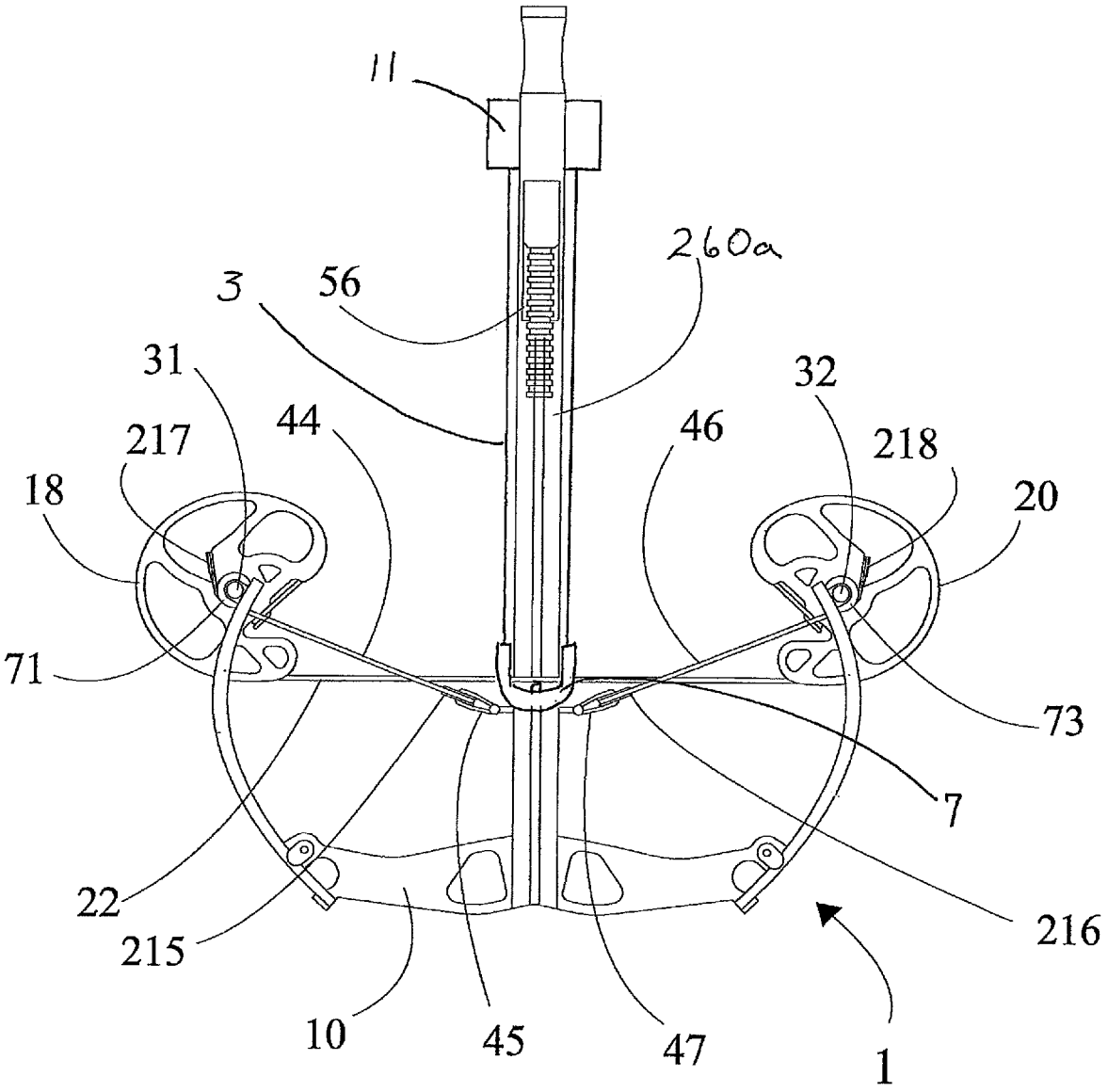
FIG. 6 is a top view of a conventional draw crossbow having inverted cams with the cocking sled in the second position of the present invention.
Figure 7:
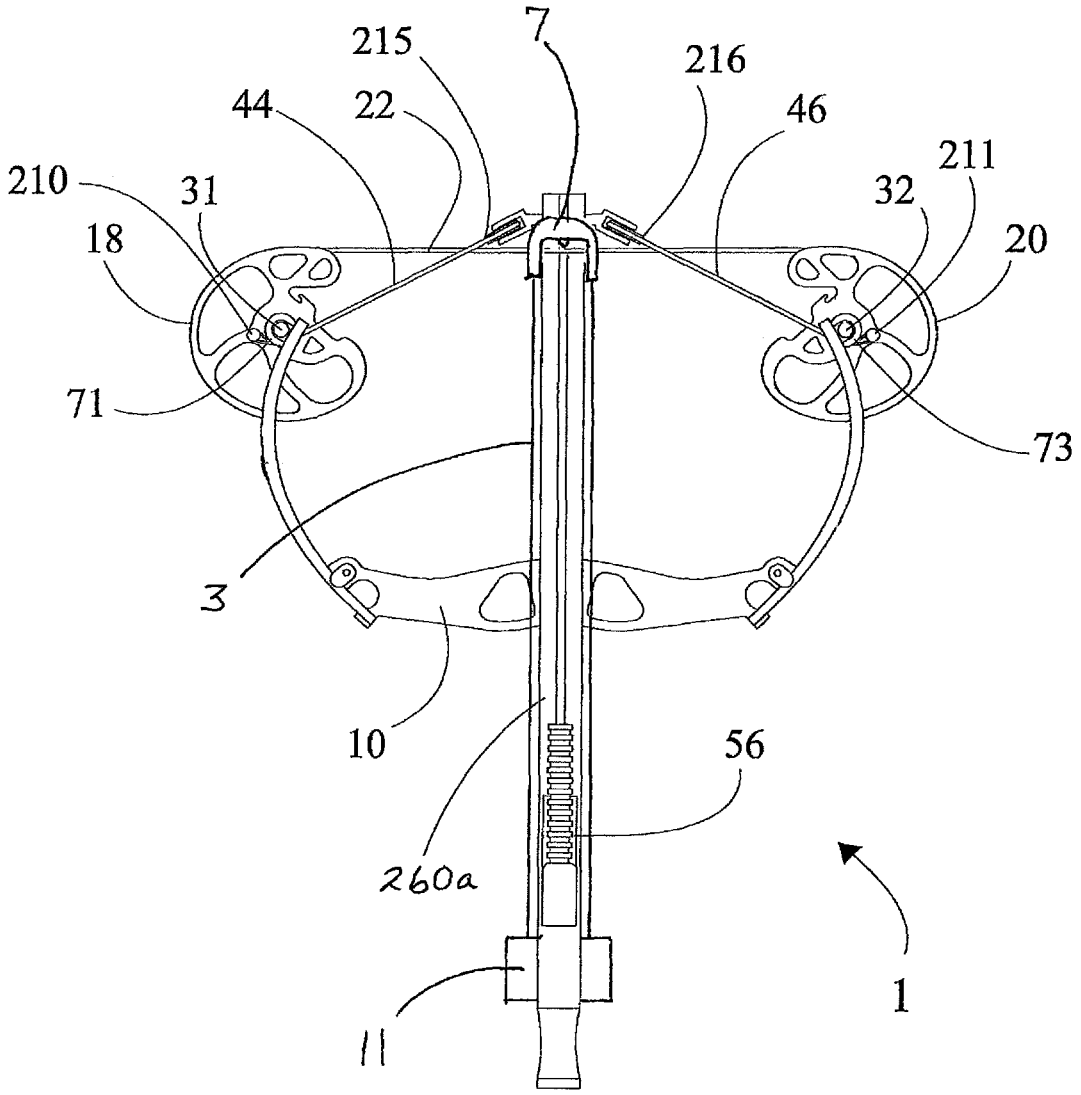
FIG. 7 is a top view of a reverse draw crossbow with the cocking sled in the second position of the present invention.

Multiple embodiments of the invention wherein the sled is movable manually by a rope, as in a rope cocker 5 which reduces draw force by half, as shown in FIG. 1A, a mid-segment 3*a* of the flexible member 3 is positioned adjacent in a proximal receiver on the crossbow (not shown) in order to create a pulley effect. Another embodiment integrates components to create what is known in the art as a direct-pull cocker 6 which requires full draw force. When used as a direct-pull type cocking device as shown in FIG. 1B, the flexible member 3 may be replaced with any object or material sufficient to join the cocking sled body 7 with a handle 18 or the like. In yet another embodiment, the use of an mopm device, or any other method known in the art of moving a cocking sled to cock and or de-cock a crossbow. Though the present invention has been characterized as generally "U" shaped, any shape that allows for the function of retainment a bowstring to complete the process of cocking and or unlocking a crossbow as prescribed shall be considered an alternate embodiment. Further, the present invention may be utilized with projectile launching devices that are known as "rail-less" in design.

It is to be understood that though the specifications described and the drawing illustrated the preferred embodiments of the invention, alterations in shape, size, type of material and process of manufacture do not fall outside the scope of the invention.

We claim:

1. A cocking sled for cocking a crossbow; said cocking sled having a structural body, wherein said structural body is generally "U" shaped, has an upper surface, a lower surface, a barrel engagement surface, a first side, a mid section, and a second side; said structural body lower surface having an integrated bowstring retainment track on said first side and said second side; a portion of said structural body is forward the most rear portion of said bowstring retainment tracks, a portion of said structural body is rearward of the most rear portion of said string retainment tracks, wherein no portion of said body rearward of most rear portion of said string retainment track is below said barrel engagement surface.

2. The cocking sled of claim 1 wherein said cocking sled is integrated with components comprising what is known in the art as a rope cocker.

3. The cocking sled of claim 1 wherein said cocking sled is integrated with components comprising what is known in the art as a direct-pull cocker.

4. The cocking sled of claim 1 wherein said cocking sled is integrated with components comprising what is known in the art as a crank cocker.

5. The cocking sled of claim 1 wherein said cocking sled is integrated with components comprising what is known in the art as a powered cocker.

6. The cocking sled of claim 1 wherein said cocking sled may have a centering boss, and/or an anti-dryfire de-activation boss.

7. A cocking sled for cocking a crossbow; said cocking sled having a structural body, wherein said structural body is generally "U" shaped having a first leg, a mid section, and a second leg; wherein said first and said second legs have an upper surface and a lower surface, said mid section has an upper surface and a lower surface, said structural body having an integrated bowstring retainment track on said lower surface of said first leg and said second leg; a portion of said legs are forward the most rear portion of said bowstring retainment tracks, a portion of said legs are rearward of the most rear portion of said string retainment tracks, wherein no portion of said legs rearward of most rear portion of said string retainment track is below an upper bowstring engagement surface of said bowstring retainment tracks.

8. The cocking sled of claim 7 wherein said cocking sled is integrated with components comprising what is known in the art as a rope cocker.

9. The cocking sled of claim 7 wherein said cocking sled is integrated with components comprising what is known in the art as a direct-pull cocker.

10. The cocking sled of claim 7 wherein said cocking sled is integrated with components comprising what is known in the art as a crank cocker.

11. The cocking sled of claim 7 wherein said cocking sled is integrated with components comprising what is known in the art as a powered cocker.

12. The cocking sled of claim 7 wherein said cocking sled may have a centering boss, and/or an anti-dryfire de-activation boss.

* * * * *